US007441740B2

(12) United States Patent
Drew

(10) Patent No.: US 7,441,740 B2
(45) Date of Patent: Oct. 28, 2008

(54) CORNER PROTECTOR

(76) Inventor: Thomas J. Drew, 36 Bay Edge Ct., Fairfield, CT (US) 06824

( * ) Notice: Subject to any disclaimer, the term of this patent is extended or adjusted under 35 U.S.C. 154(b) by 95 days.

(21) Appl. No.: 11/091,988

(22) Filed: Mar. 29, 2005

(65) Prior Publication Data

US 2005/0217205 A1 Oct. 6, 2005

Related U.S. Application Data

(60) Provisional application No. 60/557,280, filed on Mar. 29, 2004.

(51) Int. Cl.
*A47B 95/00* (2006.01)

(52) U.S. Cl. ..... 248/345.1; 428/122; 52/288.1; 267/139; 206/453; 150/154; 108/27

(58) Field of Classification Search ..... 248/345.1; 108/27; 206/521, 586, 453; 52/288.1, 287.1; 267/139, 140; 428/122; 150/154, 158
See application file for complete search history.

(56) References Cited

U.S. PATENT DOCUMENTS

| | | | | | |
|---|---|---|---|---|---|
| 2,057,942 | A * | 10/1936 | Fay | 446/112 |
| 2,564,386 | A | 8/1951 | Webb | 5/93 |
| 2,600,556 | A | 6/1952 | Malm | 5/93 |
| 3,137,087 | A * | 6/1964 | Shroyer | 248/345.1 |
| 3,166,227 | A * | 1/1965 | Ragnow | 206/523 |
| 3,314,584 | A * | 4/1967 | Knapp et al. | 206/586 |
| 3,334,798 | A * | 8/1967 | Pezely, Jr. et al. | 206/594 |
| 3,410,474 | A * | 11/1968 | Keil | 206/586 |
| 3,580,469 | A | 5/1971 | Reese | 229/14 |
| 3,695,421 | A * | 10/1972 | Wood | 206/523 |
| 3,946,874 | A * | 3/1976 | Breth et al. | 206/523 |
| 4,776,049 | A * | 10/1988 | Perron | 5/640 |
| 4,817,902 | A * | 4/1989 | Mason | 248/345.1 |
| 4,998,699 | A | 3/1991 | Butler | 248/188.7 |
| 5,006,386 | A * | 4/1991 | Menichini | 428/58 |
| 5,058,566 | A * | 10/1991 | Dabbs et al. | 126/500 |
| 5,060,902 | A * | 10/1991 | Hartman | 248/345.1 |
| 5,065,972 | A | 11/1991 | Buckshaw et al. | 248/345.1 |
| 5,330,814 | A | 7/1994 | Fewell | 428/41 |
| 5,607,339 | A * | 3/1997 | Kramer | 446/491 |
| 5,642,545 | A | 7/1997 | Howard | 5/663 |
| 5,803,423 | A * | 9/1998 | Harrell | 248/345.1 |
| 6,202,848 | B1 * | 3/2001 | Tindoll et al. | 206/522 |
| 6,224,955 | B1 * | 5/2001 | Gorski | 428/35.2 |
| 6,607,419 | B2 * | 8/2003 | Day et al. | 446/226 |

* cited by examiner

*Primary Examiner*—Kimberly T. Wood
(74) *Attorney, Agent, or Firm*—Ohlandt, Greeley, Ruggiero & Perle, L.L.P.

(57) ABSTRACT

An impact protection apparatus has a body portion formed of a first resilient material and a number of members protruding radially outward from the body portion. The members are formed of a second resilient material which is the same as or different from the first resilient material. The impact protection apparatus has an adhesive material or a mechanical fastener disposed about the body portion and/or the members. The apparatus may be affixed to a surface.

5 Claims, 4 Drawing Sheets

CORNER PROTECTOR

CROSS REFERENCE TO RELATED PATENT APPLICATIONS

This patent application hereby claims priority to U.S. Provisional Patent Application Ser. No. 60/557,280 filed on Mar. 29, 2004 which is herein incorporated by reference in its entirety.

BACKGROUND OF THE INVENTION

1. Field of the Invention

The present invention relates to a device that protects young children. More particularly, the present invention relates to a guard device that protects infants from a corner of furniture, glass, or other dangerous conditions in a household setting.

2. Description of the Related Art

Corner guards for tables are known in the art. One such corner guard is disclosed in U.S. Pat. No. 4,817,902 to Mason. Mason discloses a two-part corner protector. The corner guard provides for a padded covering of a corner of a structure. The two-part corner protector has a resilient inner core and a separate flexible outer cover that is disposable about the resilient inner core. The two-part corner protector further includes a padding therein and has an arrangement of tie strings and an elastic hem. The tie strings and the elastic hem attach the outer member to the inner member and the corner of a table for protection purposes.

The corner guards of the prior art are deficient in their operation. The corner guards have a distinct and asymmetric shape and cannot be used to provide protection for other dangerous conditions such as at an edge of a table adjacent to the corner, over electrical appliances or over a glass windowpane. Although, the corner guard is disposed over the corner, the edge of the table is not protected whatsoever and poses a danger, especially to an infant or toddler. Further, the corner guards of the prior art have a number of corners that may potentially bulge outward, especially when placed adjacent to another second corner guard. Moreover, upon bulging, the prior art corner guards provide no relief when placed over an edge of a table. There is a need in the art, to provide corner guards that have a symmetric shape relative to another second corner guard that prevents such bulging and thus provides relief.

Moreover, the arrangement of tie strings and the elastic hem to attach to the corner of the table although providing cushioning by the padding still do not provide an adequate amount of protection, especially in the instance of a fall where relatively great force occurs relative to a mere bump. For example, if a child were to fall across the corner guard rather than bumping into the corner guard in a perpendicular fashion, the tie strings of the corner guard would be pulled off the corner due to an amount of shear stress applied to the tie strings. The corner guard would slide down the leg of the table and thus leave the corner unprotected.

Further, the corner guard still does not provide adequate protection and the infant may become injured if the corner guard merely has the padding therein. The padding, although absorbing an amount of the force, will deform a great amount in a direction toward the corner that is relatively hard and relatively sharp. This may result in the padded corner still being able to bruise and/or provide discomfort to the infant in a relatively higher force collision.

The corner guard of the prior art still further does not have any shape that would allow the user for selectively add or subtract protection to the corner guard by adding a second corner guard adjacent to or even over the first corner guard to remedy this concern. A parent with a larger infant or relatively busier toddler may wish to have added protection at a number of different locations at the home where danger may be perceived.

The prior art only contemplates adding one corner guard to each corner of the table. The prior art does not contemplate any configuration where the user may wish to selectively add more protection to one corner over another or even add protection to the edge to bolster an overall protection that is offered at a potentially dangerous location in a home, such as for example at a kitchen.

Accordingly, there is a need for a protection device that eliminates one or more of the aforementioned drawbacks and deficiencies of the prior art.

There is also a need to provide a corner protector that has a number of prongs that are flexible.

There is a need to provide a corner protector that has an adhesive thereon that is easy to apply to a dangerous location.

There is a need to provide a corner protector that has a symmetric shape.

There is a need to provide a corner protector that may be applied to both a corner and an edge of furniture.

There is a need to provide a corner protector that can be applied in a modular fashion to selectively increase or decrease apply protection to a dangerous condition.

There is a need to provide a corner protector that has an aesthetically pleasing design being disposed thereon.

There is a need to provide a corner protector that has a body with an outer surface and a number of prongs extending from the body defining spaces with the spaces having a complementary size so that prongs of another second corner protector may fit therein.

SUMMARY OF THE INVENTION

According to a first embodiment of the present invention, there is provided an impact protection apparatus. The apparatus has a body portion formed of a first resilient material and a number of members protruding radially outward from the body portion. The members are formed of a second resilient material which is the same as or different from the first resilient material. The impact protection apparatus has an adhesive material or a mechanical fastener disposed about the body portion and/or the members. The apparatus may be affixed to a surface.

According to another embodiment of the present invention, the impact protection apparatus protects an infant from a hazardous condition and has a plurality of modular components with each having a complementary configuration relative to one another. The modular components interleaf with one another and each are removably connected to the hazardous condition. The modular components cover and pad the hazardous condition.

According to another preferred embodiment of the present invention, the impact protection apparatus has a first modular component with a body portion formed of a first resilient material and a second modular component having a complementary configuration relative to the first modular component. The first modular component is interleafed with the second modular component. The hazardous condition is covered by at least one of the first modular component and the second modular component.

According to still another preferred embodiment of the present invention there is provided a method of protecting a user against a dangerous location having a first portion and a second portion connected to the first portion forming an edge. The method has the steps of providing an impact protection apparatus with a body portion formed of a first resilient material and a plurality of members protruding radially outward from the body portion. The members are formed of a second resilient material which is the same as or different as the first resilient material. The apparatus has an adhesive material or a mechanical fastener disposed about the body portion the members. The method also has the step of connecting one of the members to the first portion and connecting a second one of the members to the second portion. The impact protection apparatus then covers the edge.

DETAILED DESCRIPTION OF THE PREFERRED EMBODIMENT

Figure 1:
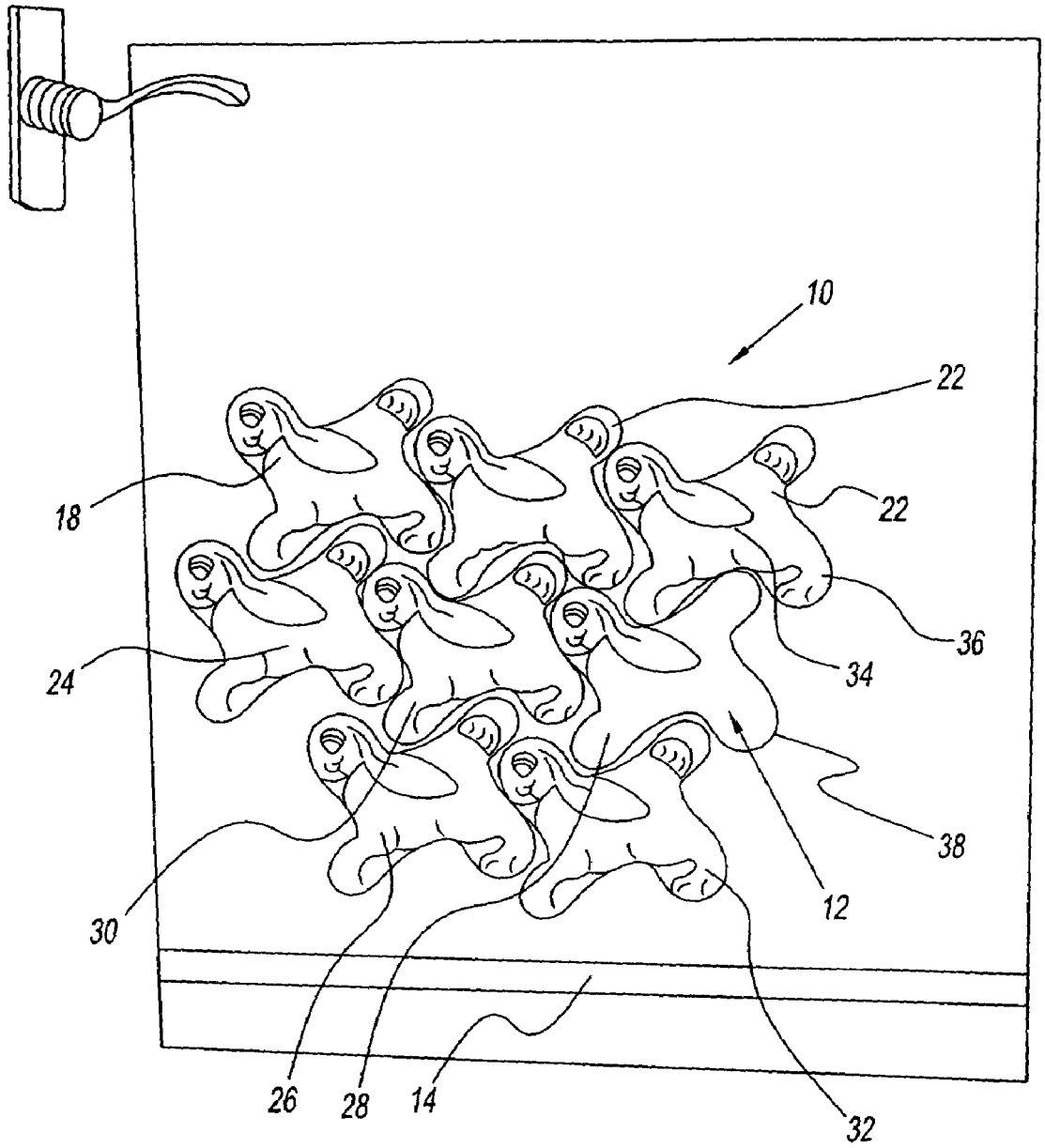
FIG. 1 is a front view of a preferred embodiment of a bumper assembly according to the present invention connected to a glass pane of a door.

Referring to FIG. 1, there is provided a bumper assembly of the present invention generally represented by reference numeral 10. The bumper assembly 10 preferably is a configuration of a number of bumpers 12. Preferably, each of the bumpers 12 can be connected to one another or contiguously at a number of different locations to cover a potentially hazardous location of a household, such as a corner of a furniture item, an edge of a furniture item, an electrical appliance or a window. Preferably, a user can selectively create the bumper assembly 10 and selectively increase or decrease an amount of protection by connected the number of bumpers 12 in a modular type fashion.

Each of the number of bumpers 12 preferably has a substantially symmetrical shape. In one embodiment of the present invention, the number of bumpers 12 each may have a shape. The shape may be a trapezoid, a square, a rectangle, a parallelogram, a symmetrical shape, and any combinations thereof. One skilled in the art should appreciate that each of the bumpers 12 provide relief, especially in the instance of when arranged in the bumper assembly 10. Each of the bumpers 12 preferably can be folded over an edge, a sharp corner, an electrical outlet, glass, or a dangerous surface without bulging against another bumper of the bumper assembly 10 or a portion of the individual bumper. This permits each bumper 12 providing a maximum amount of protection against the dangerous surface. Preferably, each of the bumpers 12 of the bumper assembly 10 preferably has a shape that exhibits symmetry. Moreover, when each of the bumpers 12 is folded over and connected to an edge of a dangerous surface, the bumper exhibits relief that is to say that the bumper does not have any portion that bulges outward to reveal the edge, and instead interlocks with the adjacent bumper. Referring the figures and in particular FIG. 1, the number of bumpers 12 are shown as being connected and protecting a translucent glass panel 14 that is a portion of a doorway 16. In this embodiment, there is a risk of a toddler brushing up against the doorway 16 and glass panel 14 and shattering the glass panel, thus causing injury to the toddler. Bumper assembly 10 preferably absorbs an impact of the brush against the door and thereby prevents the doorway from shattering, and thus protects the toddler from harm.

The bumper assembly 10 optionally has a plurality of bumpers 10, e.g., eight bumpers, or more particularly a first bumper 18, a second bumper 20, a third bumper 22, a fourth bumper 24, a fifth bumper 26, a sixth bumper 28, a seventh bumper 30 and an eighth bumper 32. One significant aspect of the present invention is that the user may selectively increase or decrease an amount of padding or protection between the dangerous location and the toddler by connecting more or less of the number of bumpers 12 to the preselected dangerous location located in the home.

As is shown in FIG. 1, the user connects each bumper 12 of the bumper assembly 10 to glass panel 14 at a lower most portion of the doorway 16 where a toddler or infant normally may traverse across. The first bumper 18 is connected to both the second bumper 20 and the fourth bumper 24 to prevent any relatively large sized spaces between the bumpers 12 in the bumper assembly 10 from exposing glass panel 14 of the doorway 16. Second bumper 20 is connected to both the first bumper 18 and third bumper 22 and further is connected to both the fifth bumper 26 and sixth bumper 28. This modular arrangement further prevents substantially any spaces therebetween. Various combination and orientations of bumper assembly 10 are possible and are all within the scope of the present invention. It has been observed that the bumpers 10 have a number of unexpected benefits over the prior art. These unexpected superior benefits are the fact that the bumpers 10 may be tailored to pad any dangerous surface that the user may encounter in a home or other environments. Most prior art solutions have a geometry that is fixed and tailored to a specific type of hazardous condition. The bumper 10 of the present invention in a modular fashion may interleaf with other bumpers to cover unspecific types of hazardous condition that are not contemplated upon purchase.

Each of the bumpers 10 is substantially "X" shaped and has a body 34 with a number of prongs or legs 36. Each of the prongs 36 is substantially flexible and has a rounded edge 38. Each prong 36 is integrally connected to the body 34. Preferably, each prong 36 is integrally connected to body 34 by a molding operation. Although, one skilled in the art should appreciate that body 34 may be connected to one or more of the number of prongs 36 by any method in the art such as by fasteners or an adhesive. Preferably, both the number of prongs 36 and body 34 are both substantially flat. However, alternatively, body 34 and prongs 36 may have a number of dimples thereon, a message, or a pattern.

Figure 2:
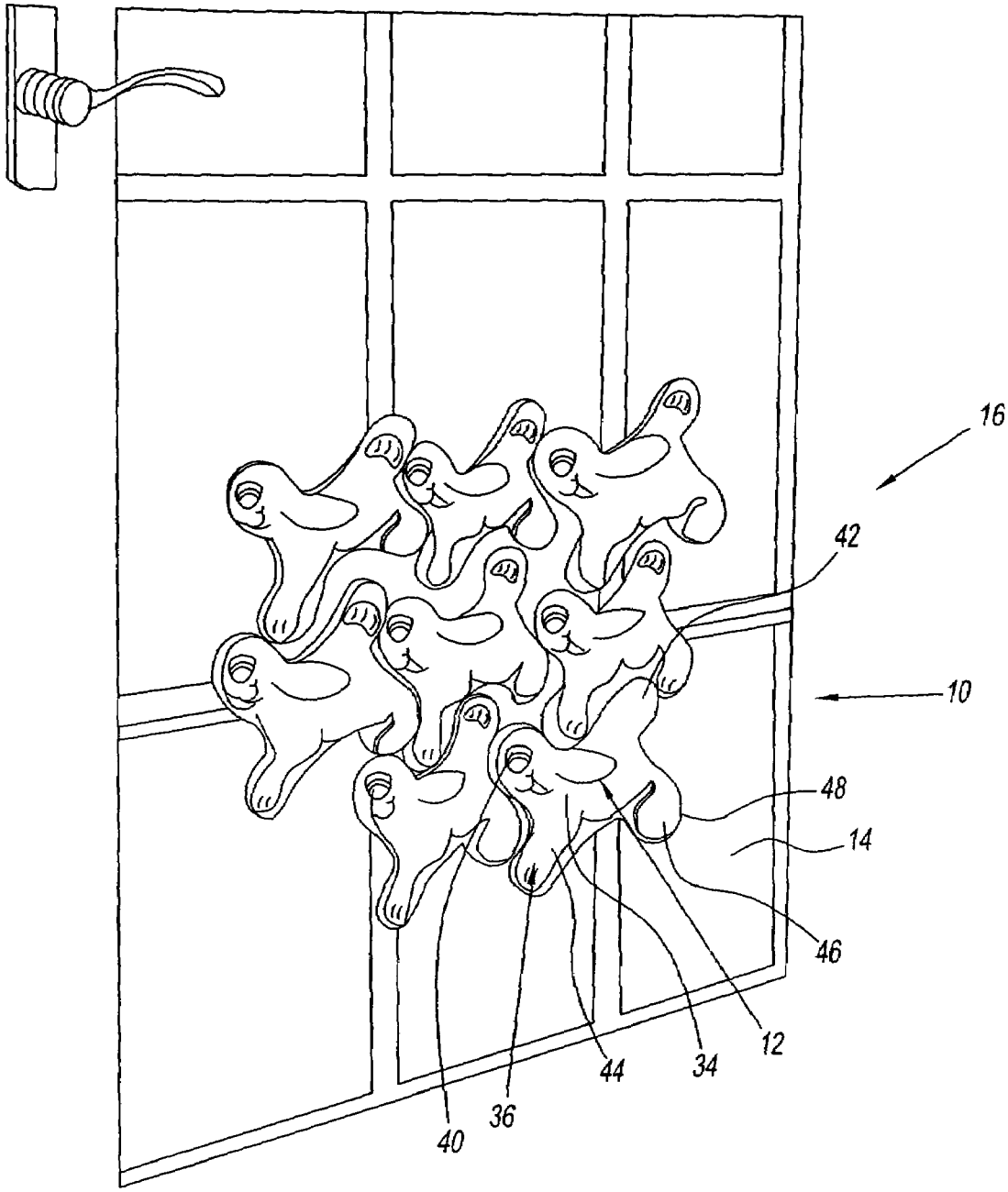
FIG. 2 is a side perspective view of the bumper assembly of FIG. 1.

Referring to FIG. 2, bumper 12 is shown in bumper assembly 10. As stated each bumper 12 preferably is made from a flexible or resilient elastomeric material, e.g., a foam rubber. Each bumper 12 preferably is a polyvinyl chloride. Less preferably, each bumper 12 may be alternatively other closed cell resistant foam plastic material, such as a foam rubber. Still further, less preferably each bumper 12 may be polypropylene, polyurethane, polyethylene, a composite material or any combinations thereof.

Preferably, body 34 has a substantially "X" shape with the number of prongs 36 extending opposite from the body. In a most preferred embodiment of the present invention, bumper 12 has four prongs 36, each of the four prongs extending opposite from body 34 in four different locations. Preferably, the bumper 12 has a first prong 40, a second prong 42, a third prong 44, and a fourth prong 46. Preferably, first and fourth prongs 40, 46 have a first width and second and third prongs 42, 44 have a second width. The first width is different than the second width. The bumper 12 has the first through fourth prongs 40, 42, 44, 46 protruding radially outwardly from the body. The body further has a first lateral axis and a second longitudinal axis being perpendicular to the first lateral axis. The first prong 40 preferably forms a first angle relative to the first lateral axis in a range that includes about forty-five degrees to about ninety degrees. The second prong 42 preferably forms a second angle relative to the first lateral axis being in a range that includes about zero degrees to about forty-five degrees. The third prong 44 preferably forms a third angle relative to the first lateral axis being in a range that includes about forty-five degrees to about ninety degrees. The fourth prong 46 forms a fourth angle relative to the first lateral axis in a range that includes about zero degrees to about forty-five degrees.

Each of the prongs further has a tip 48. Most preferably, tip 48 is rounded. In this preferred embodiment, bumper 12 has first prong 40, second prong 42, third prong 44, and fourth prong 46 with each of first through fourth prongs having rounded tip 48. Most preferably, tip 48 is smooth and rounded, however one skilled in the art should appreciate that the tip may have any shape known in the art and that lacks any sharp edges to prevent any injury when a toddler brushes up or contacts the tip.

Figure 3:
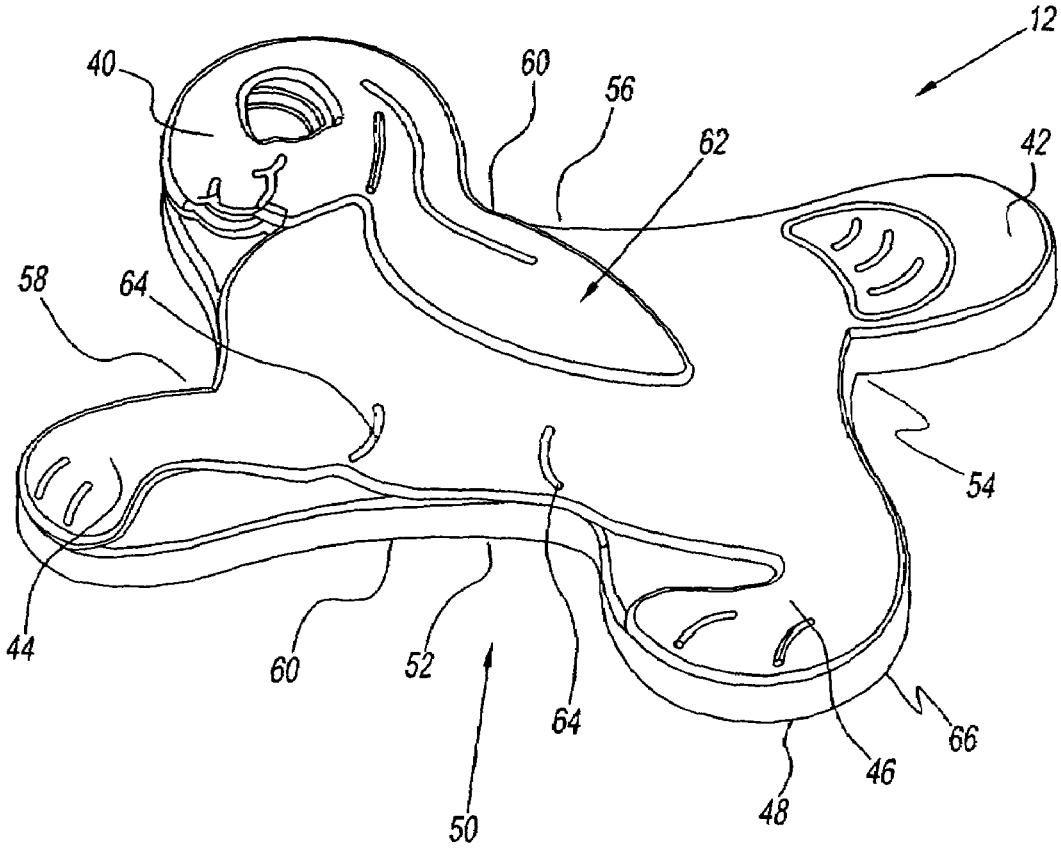
FIG. 3 is another enlarged view of a bumper of FIG. 1.

Referring to FIG. 3, each bumper 12 further has a number of spaces 50. In this most preferred embodiment of the present invention, bumper 12 has four spaces, or a first space 52, a second space 54, a third space 56, and a fourth space 58. Preferably, each space 50 has a rounded bottom most portion 60. As mentioned, the bottom most portion 60 may have any shape known in the art and that lacks any sharp edges to prevent any injury when a toddler brushes up or contacts thereon.

A significant aspect of the present invention is that each space 60 has a complementary size with respect to a size of prongs 36 such that each the prong may be inserted in the respective space 50 to prevent exposing the toddler from the dangerous condition that bumper assembly 10 is protecting the toddler from. Referring still to FIG. 3, there is shown an enlarged close up view of bumper 12 in a pleasing shape. Preferably, bumper 12 is made from a suitable molded foam rubber material that can be easily bent to surround a portion an article of furniture. However, one skilled in the art should appreciate that bumper 12 may be made from any other suitable resilient and lightweight material that is lightweight and can readily absorb an impact from the toddler. Bumper 12 further has a pattern 62 being disposed thereon. Pattern 62 is preferably a pattern for the overall bumper to have a bunny shaped pattern. Less preferably, pattern 62 may be any animal shape, "X" shaped, a message, or aesthetically pleasing children's design known in the art such as a robot, a fish or any other pleasing decorative shape.

Referring again to FIG. 3, each bumper 12 has a first width being in a range that includes 0.34 inches thick to about 0.46 inches thick. Bumper 12 may further have a number of protrusions 64 being molded thereon for forming pattern 62. Bumper 12 has protrusions 64 being disposed thereon being raised and having dimensions of 0.03 and a width of 0.06 wide. Disposed on an opposite side of the bumper is a connector 66. Preferably, connector 66 is an adhesive that is connected to a backside of bumper 12. Alternatively, connector 66 may be an adhesive strip or an adhesive tape. Less preferably, the connector 66 may be a suction cup or a mechanical fastener. Connector 66 preferably is suitable to surround substantially the entire backside of bumper 12 or at least a portion that is suitable for holding a weight of bumper 12 on a dangerous surface such as glass panel 14 to provide protection thereon.

Figure 4:
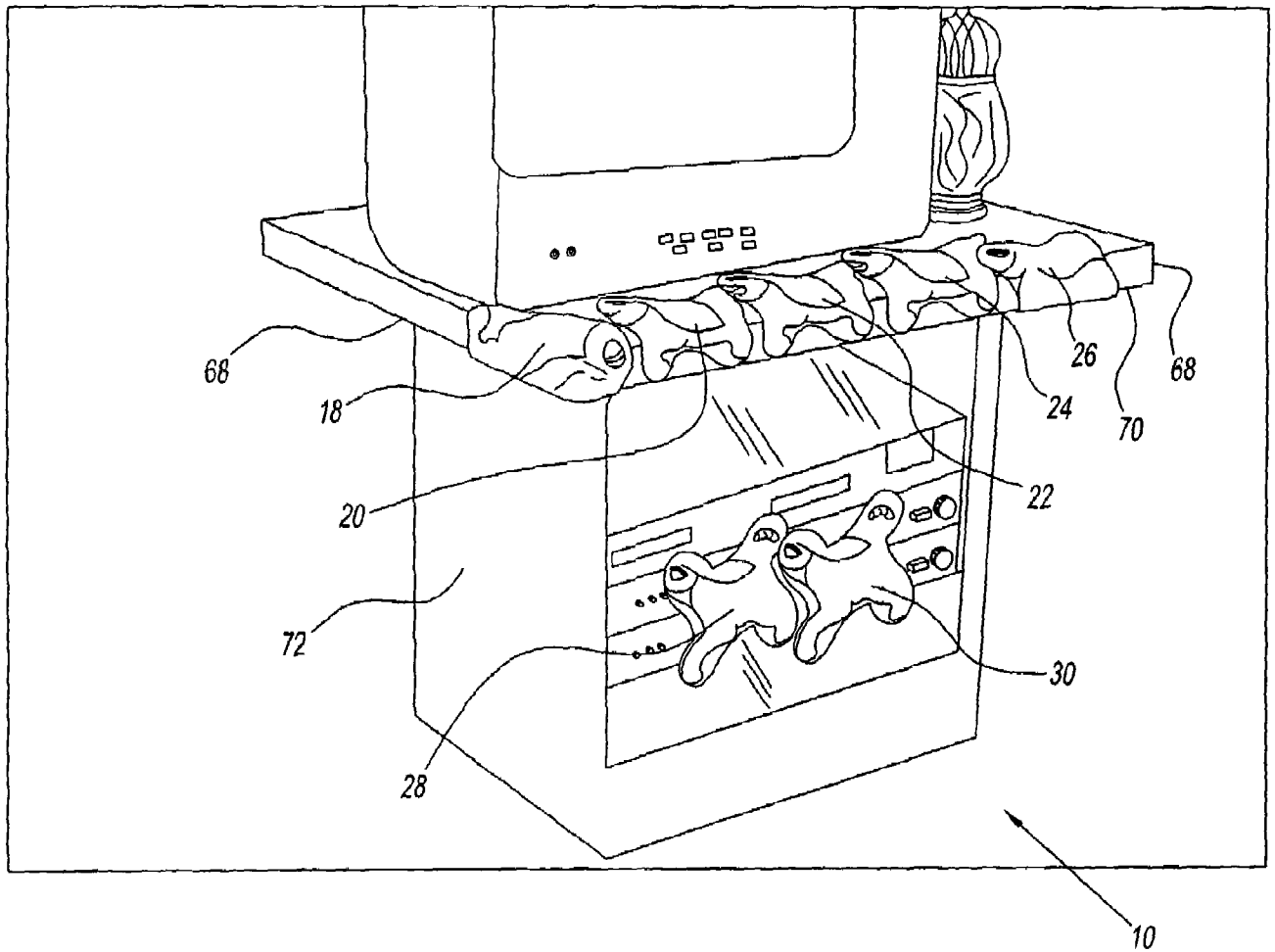
FIG. 4 is a perspective view of the bumper assembly of FIG. 1 being over a furniture item and a number of appliances.

Referring to FIG. 4, there is shown a preferred embodiment of bumper assembly 10. In this embodiment of the present invention, bumper assembly 10 is connected in modular fashion to surround corners 68 of a furniture item and also an edge 70. Preferably, in this preferred embodiment, bumper assembly 10 has first bumper 18, second bumper 20, third bumper 22, fourth bumper 24 and fifth bumper 26 each being connected to one another. Each bumper 12 in bumper assembly 10 preferably has flexibility and can bend to preferably surrounds edge 70 of the furniture and remain connected in this preferred orientation by connector 66 until physically removed by the user.

Still further, bumper assembly 10 further comprises sixth and a seventh bumper 28, 30 connected over an appliance 72 such as a videocassette recorder, digital video disc, digital video recorder, set top box, digital device, or stereo having apertures to prevent a toddler from placing his or her fingers in the apertures of the appliance. One skilled in the art should appreciate that bumper assembly 10 can be engaged and disengaged very easily without leaving any adhesive on the furniture or the appliances, yet be easily reapplied by connector 66 to provide a balance between a ready use of the appliance and the protection.

The present invention preferably has a number of symmetrical and complementary prongs 36 that uniquely permit the following uses simultaneously in one bumper 12. The bumper 12 can fit on any surface including but not limited to (i) a corner, (ii) a non-corner, (iii) a flat surface, (iv) a non-flat surface, (v)an edge, (vi) a surface of any material (wood, metal, glass, etc.). Another aspect of the prongs 36, is that the prongs provide relief or non-bulging or non-curling when the bumper 12 is applied to such a surface. The bumper 12 thus is helpful for corners and other non-flat surfaces or surfaces with two or more surfaces. The bumper 12 further has the symmetrical/complementary prongs 36 that can be used on all of these surfaces and for all these purposes at once. The symmetrical/complementary prongs 36 fits and/or nest continuously for maximum protection.

In one preferred embodiment of the present invention, each bumper 12 may have a maximum length of about 7.5 inches and a maximum height of 7.0 inches. The bumper 12 may further has prongs 36 with each prong having a radius of curvature in a range that includes about 2.30 inches to about 0.75 inches. Moreover, each bumper 12 may have an aperture or cut away portion that is in a range that includes a radius of curvature in a range that includes about 0.3750 inches to about 1.50 inches. One skilled in the art should appreciate that the bumper 12 is not limited to these dimensions and may be formed from any suitable dimensions being known in the art.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A human impact protection apparatus for protecting a user against a dangerous location, the human impact protection apparatus comprising:

a body portion formed of a first resilient material;

four members substantially spaced apart protruding radially outward from said body portion, said four members being formed of a second resilient material which is the same as or different from said first resilient material, said four members each having a rounded tip; and an adhesive material or a mechanical fastener disposed about one or both of said body portion and said four members, whereby the human impact protection apparatus may be affixed to a surface, and whereby the human impact protection apparatus may be modularly interleafed with another human impact protection apparatus to substantially prevent any spaces therebetween, wherein said body portion and said four members have a substantially symmetrical shape and are foldable over a plurality of different shaped surfaces to cover said plurality of different shaped surfaces without bulging, wherein said four members protruding radially outwardly from said body portion are a first member, a second member, a third member, and a fourth member, and wherein said body has a first lateral axis and a second longitudinal axis being perpendicular to said first lateral axis, said first member forming a first angle relative to said first lateral axis being in a range that includes forty five degrees to ninety degrees, said second member forming a second angle relative to said first lateral axis being in a range that includes zero degrees to forty five degrees, said third member forming a third angle relative to said first lateral axis being in a range that includes forty five degrees to ninety degrees, and wherein said fourth member forms a fourth angle relative to said first lateral axis being in a range that includes zero degrees to forty five degrees.

2. The human impact protection apparatus of claim 1, wherein said body portion has a shape, said shape being selected from the group consisting of a trapezoid, a square, a rectangle, a parallelogram, a symmetrical shape, and any combinations thereof.

3. The human impact protection apparatus of claim 1, wherein said four members protruding radially outward from said body portion curve around an angle of the surface, each of said four members not bulging from the surface.

4. The human impact protection apparatus of claim 1, wherein said first resilient material is selected from the group consisting of a flexible material, a resilient elastomeric material, a foam rubber, a polyvinyl chloride, a closed cell resistant foam plastic material, a foam rubber, a polypropylene, a polyurethane, a polyethylene, a composite material, and any combinations thereof.

5. The human impact protection apparatus of claim 1, wherein said second resilient material is selected from the group consisting of a flexible material, a resilient elastomeric material, a foam rubber, a polyvinyl chloride, a closed cell resistant foam plastic material, a foam rubber, a polypropylene, a polyurethane, a polyethylene, a composite material, and any combinations thereof.

* * * * *